US012305965B2

(12) United States Patent
Spanner

(10) Patent No.: US 12,305,965 B2
(45) Date of Patent: May 20, 2025

(54) PROJECTILE, IN PARTICULAR DEFORMATION AND/OR PARTIAL FRAGMENTATION PROJECTILE, AND METHOD FOR PRODUCING A PROJECTILE

(71) Applicant: RUAG Ammotec GmbH, Fürth (DE)

(72) Inventor: Florian Spanner, Nuremberg (DE)

(73) Assignee: RUAG Ammotec GmbH, Fürth (DE)

( * ) Notice: Subject to any disclaimer, the term of this patent is extended or adjusted under 35 U.S.C. 154(b) by 5 days.

(21) Appl. No.: 17/618,318

(22) PCT Filed: Jun. 12, 2020

(86) PCT No.: PCT/EP2020/066387

§ 371 (c)(1),
(2) Date: Dec. 10, 2021

(87) PCT Pub. No.: WO2020/249788

PCT Pub. Date: Dec. 17, 2020

(65) Prior Publication Data

US 2024/0302145 A1 Sep. 12, 2024

(30) Foreign Application Priority Data

Jun. 13, 2019 (DE) ..... 10 2019 116 125.8

(51) Int. Cl.
*F42B 12/34* (2006.01)
*F42B 12/36* (2006.01)
*F42B 33/00* (2006.01)

(52) U.S. Cl.
CPC ..... *F42B 12/367* (2013.01); *F42B 12/34* (2013.01); *F42B 33/00* (2013.01)

(58) Field of Classification Search
CPC ..... F42B 12/34; F42B 12/36; F42B 12/367; F42B 33/00

(Continued)

(56) References Cited

U.S. PATENT DOCUMENTS 3,401,637 A 9/1968 Briscoe
5,259,320 A 11/1993 Brooks (Continued)

FOREIGN PATENT DOCUMENTS

DE 10042711 A1 3/2001
DE 202005013495 U1 9/2006

(Continued)

OTHER PUBLICATIONS

International Search Report for PCT/EP2020/066387 mailed Sep. 17, 2020.

(Continued)

*Primary Examiner* — James S Bergin
(74) *Attorney, Agent, or Firm* — Fitch, Even, Tabin & Flannery LLP

(57) ABSTRACT

The present invention relates to a projectile, in particular deformation and/or partial fragmentation bullet, comprising an essentially cylindrical projectile tail, an adjoining bow sided projectile head with an essentially central opening which opens into a cavity that extends axially from the projectile head in the direction of the projectile tail, preferably into the projectile tail, which has a cavity bottom and is bounded by a wall, and an tear-off groove introduced into the wall and, at least partially surroundings the cavity, which is arranged at a distance of at least 10% of the longitudinal extension of the cavity from the cavity bottom and has a radial depth of at least 10% of a caliber diameter and/or of at least 30% of a radial wall thickness of the wall surrounding the cavity.

10 Claims, 9 Drawing Sheets

Figure 2:
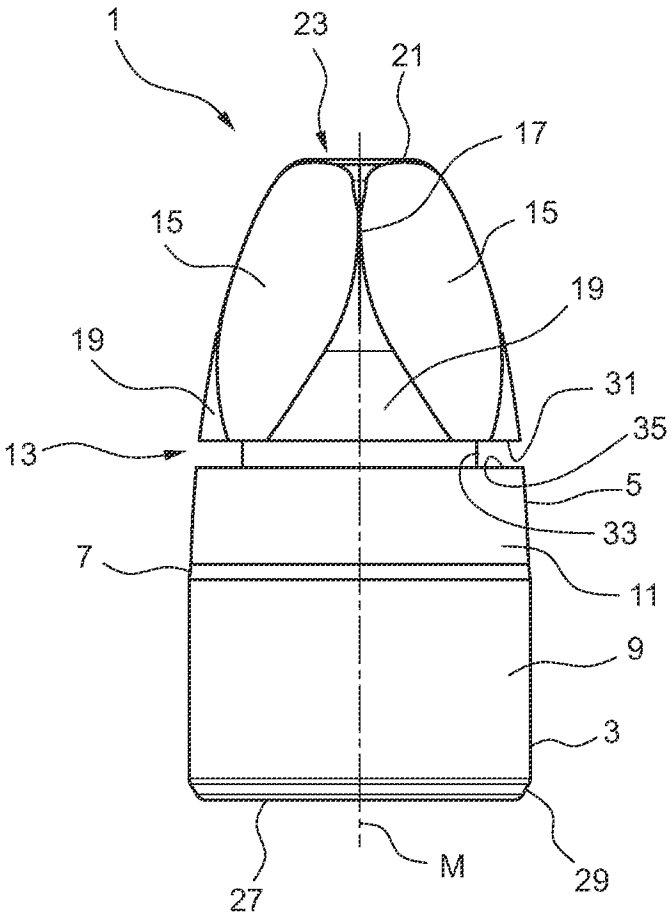

(58) Field of Classification Search
USPC ..... 102/506, 507, 508, 509
See application file for complete search history.

(56) References Cited

U.S. PATENT DOCUMENTS

| | | | | |
|---|---|---|---|---|
| 9,488,453 | B2 * | 11/2016 | Dikhoff | F42B 12/02 |
| 9,677,862 | B2 * | 6/2017 | Hendrixson | F42B 12/34 |
| 10,072,914 | B2 * | 9/2018 | Flint | F42B 12/367 |
| 10,502,536 | B2 * | 12/2019 | Mahnke | F42B 12/02 |
| 10,578,410 | B2 * | 3/2020 | Mahnke | F42B 10/24 |
| 10,969,209 | B2 * | 4/2021 | Stock, Jr. | F42B 12/367 |
| 11,402,186 | B2 * | 8/2022 | Blecher | F42B 12/34 |
| 2012/0111220 | A1 | 5/2012 | King | |
| 2016/0282095 | A1 | 9/2016 | Hendrixson | |
| 2017/0205215 | A1 | 7/2017 | Sloff | |
| 2017/0322002 | A1 | 11/2017 | Mahnke | |

FOREIGN PATENT DOCUMENTS

| | | | |
|---|---|---|---|
| DE | 20 2010 010 181 | U1 | 10/2010 |
| EP | 0918208 | A1 | 5/1999 |
| EP | 2792993 | A1 | 10/2014 |
| FR | 2867266 | A1 | 9/2005 |
| WO | 00/79211 | A1 | 12/2000 |
| WO | 01/18483 | A1 | 3/2001 |

OTHER PUBLICATIONS

Office Action dated May 18, 2020 in DE Appln. No. 10 2019 116 125.8.

* cited by examiner

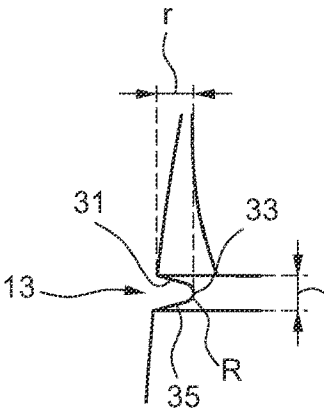
Fig. 5
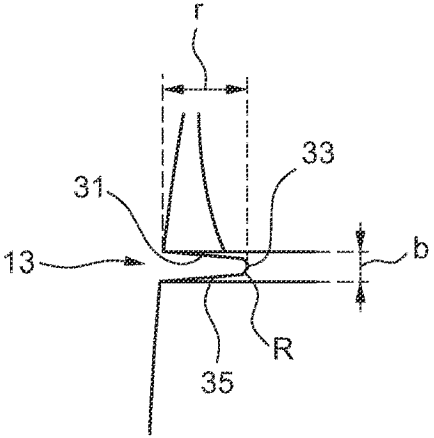
Fig. 6
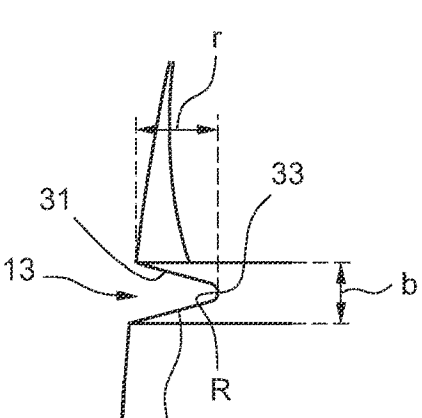
Fig. 7
Fig. 8
Fig. 9
Fig. 10
Fig. 11
Fig. 12

PROJECTILE, IN PARTICULAR DEFORMATION AND/OR PARTIAL FRAGMENTATION PROJECTILE, AND METHOD FOR PRODUCING A PROJECTILE

CROSS-REFERENCE TO RELATED APPLICATIONS

This application is a U.S. national phase application filed under 35 U.S.C. § 371 of International Application No. PCT/EP2020/066387, filed Jun. 12, 2020, which claims priority from German Application No. DE102019116125.8, filed Jun. 13, 2019, which are both incorporated herein by reference in their entireties.

The invention relates to a projectile, in particular a deformation and/or partial fragmentation bullet. The present invention also relates to a method for manufacturing a projectile, in particular a deformation and/or partial fragmentation bullet.

It is known to form solid bullets, in particular partial fragmentation bullets, with an unfilled cavity formed in the region of the ogive and having an opening provided at the ogive tip, the diameter of which is often more than 50% of the caliber of the bullet. It is known, by means of metal-cutting manufacturing processes, to incorporate in the ogive-shaped wall surrounding the cavity a number of notches which, when impacting on a jelly mass used in accordance with known test procedures to inspect and assess deformation behavior, produce a mushroom-shaped or sepal-shaped, radially outwardly bent deformation of the wall. An example of such a notched wall of the ogive section of the projectile is known from WO 2015/061662 A1. The known bullet head has a especially large ogive tip opening at which the jelly mass can enter the cavity to induce the desired deformation mentioned above. However, it has been found that the central ogive tip opening is filled by the material of greater hardness in the case of impact bodies of greater hardness, such as in the case of jelly masses surrounded by textile fabric, in the case of plaster concrete plates, etc., which is why the jelly mass, which builds up the hydraulic pressure, cannot enter the cavity, thus it does not result in the desired mushroom-shaped deformation structure.

Furthermore, it is known to produce a projectile or bullet head by means of a so-called intermediate or semi-processed product, using a cold forming process such as deep drawing. It was found with known cold-formed projectiles that the deformation behavior of the projectile does not perform as desired, especially in the standardized test procedures. With all the various proposed known punches for deep drawing the intermediate, it was found that conical or pyramidal tools used for this purpose can break easily. The service life of such tools is uneconomically low. It was also shown with the known deep drawing by means of a mandrel that stress variations and material hardening occur in the circumferential wall, which cause an uneven, hardly controllable deformation of the impacting projectile.

It is the object of the invention to overcome the disadvantages of the prior art, in particular to improve a projectile and a method for processing a projectile in such a way that an optimized, simple manufacturing is possible and the deformation and/or partial fragmentation behavior is optimized.

This object is solved by the features of claims 1 and 10.

According to one aspect of the present invention, a projectile, in particular a deformation and/or partial fragmentation bullet, is provided. Bullets or projectiles are part of a cartridge or ammunition of a firearm, in particular a handgun. The projectile is that component of the cartridge which is fired by the firearm. A partial fragmentation bullet is generally designed to fragmentate in a controlled manner to a defined residual body upon impact of the projectile with a target. Deformation bullets generally have inherent mass-stable, controlled deformation. A partial fragmentation bullet may further be designed to fragmentate to a defined residual body in a controlled manner and/or to partially deform in a controlled manner upon impact of the bullet with a target. Controlled deformation of deformation bullets is generally designed to mushroom/fold upon impact with a target, in which the deformation bullet remains generally mass stable. Such projectiles or bullets are used in particular as hunting bullets, since these lead more reliably to a quicker death of the game being shot at, during hunting due to the effective energy release by partial fragmentation and/or defined deformation in the game body.

The projectile according to the invention comprises an essentially cylindrical projectile tail arranged rearwardly with respect to the projectile flight direction. The projectile may be formed in essence completely cylindrical and/or have a constant outer diameter with respect to a projectile central axis. In particular, the outer diameter of the projectile tail defines the caliber diameter. The projectile further comprises a bow sided projectile head adjoining the projectile tail, the projectile head being forwardly disposed with respect to the projectile flight direction. The projectile head comprises a front panel opening, i.e., on the front side with respect to the projectile flight direction and thus on the face side of the projectile, which opening is essentially central and is oriented, for example, concentrically with respect to the projectile central axis. The opening may open into a cavity that extends axially from the projectile head in the direction of the projectile tail, preferably into the projectile tail. The cavity has a cavity base facing towards the projectile tail and is bounded by a wall. For example, the wall completely surrounding the cavity in the circumferential direction. The wall of the projectile head may be substantially ogive-shaped in form on the outside.

According to a first aspect of the invention, an tear-off groove at least partially circumferentially surrounding the cavity is provided in the wall. Upon impact of the bullet/projectile with a target, the tear-off groove may assist in allowing the projectile head to deform and/or fragmentate to an axial position where the tear-off groove is located. Further, provision may be made for the projectile head on the bullet bow side to be torn away from the projectile tail upon impact of the bullet with a target, namely along the tear-off groove. For example, the tear-off groove may be oriented substantially perpendicular to the longitudinal axis of the projectile and may further serve to determine the deformation and/or fragmentation behavior of the deformation and/or partial fragmentation bullet, in particular to limit deformation and/or fragmentation of the projectile. The tear-off groove is located at a distance of at least 10%, at least 20%, at least 30%, at least 40% or at about 50%, of the longitudinal extension of the cavity from the cavity base. A radial depth of the tear-off groove with respect to the longitudinal axis of the projectile is at least 10%, preferably at least 15% or at least 20%, of a caliber diameter and/or at least 30%, preferably at least 35%, at least 40%, at least 45% or at least 50%, of a radial wall thickness of the wall surrounding the cavity. According to the invention, it was found that the combination of a central cavity and an tear-off groove, in particular due to the claimed positioning and/or dimensioning of the tear-off groove in relation to the cavity, results in an advantageous deformation or partial fragmentation. When the projectile impacts a target, a combination of rupturing projectile head sections and unfolding/mushrooming projectile head sections is produced, so that an increased energy output is produced in the game by a cross-sectional enlargement as a result of the mushrooming/folding deformation and, on the other hand, by the increased destructive effect with the aid of the fragmented projectile fragments. Suitable materials for the projectile are metals, in particular ductile metals, such as copper, copper alloys, for example tombac. For example, it is provided that the tear-off groove completely surrounding the cavity.

According to an exemplary embodiment of the projectile according to the invention, a preferably completely circumferential chamfer is formed at the transition between the projectile tail and the projectile head, at which a diameter chamfer of the projectile considered with respect to the projectile central axis is continuously reduced. The caliber diameter of the projectile can be determined, for example, by the diameter in the area of the projectile tail. Due to the geometric separation between the projectile tail and the projectile head by means of the chamfer, it can be ensured that the projectile comes into contact with the barrel of a weapon exclusively in the region of the projectile tail, while the outer wall surface in the region of the projectile head remains free from frictional contact with the barrel of the weapon when the projectile is fired, so that a functional separation between the projectile tail and the projectile head is accompanied at the same time.

According to another exemplary embodiment of the present invention, the cavity extends at least 30%, preferably at least 40%, at least 50% or at least 60%, of a longitudinal extension of the projectile. It has been found that the claimed cavity axial lengths have a beneficial effect on the deformation or partial fragmentation behavior of the projectile, namely in that the length of the cavity can be used to determine/adjust the length of the projectile sections that mushroom/unfold upon impact of the projectile with a target.

In another exemplary embodiment of the projectile according to the invention, the cavity expands continuously substantially starting from the opening. On the front side of the projectile, the cavity may be formed in a funnel-shaped and/or truncated cone-shape in cross-section for a short time before the opening continuously expands. In particular, the cavity widens continuously up to an axial position of the tear-off groove. For example, it can be provided that the cavity tapers continuously again from the axial position of the tear-off groove until the cavity finally merges into the cavity base. According to an exemplary further development, the cavity is substantially drop-shaped. For example, the cavity base may be concavely curved.

In an exemplary embodiment of the projectile according to the invention, the tear-off groove is formed in a substantially U-shaped or V-shaped configuration. For example, the tear-off groove may be formed by a turning or milling process and/or may be formed in the wall.

According to an exemplary further embodiment of the projectile of the invention, the tear-off groove comprises a projectile head sided flank, a projectile tail sided flank, and a groove bottom connecting the projectile head sided flank and the projectile tail sided flank. In an exemplary embodiment, the projectile head sided flank and/or the projectile tail sided flank is curved and/or the groove bottom is formed by a radius and/or a transition between the projectile head sided flank and/or the projectile tail sided flank and the groove bottom is formed by a radius.

In another exemplary embodiment, the tear-off groove comprises a projectile head sided flank, a projectile tail sided flank, and a groove bottom connecting the projectile head sided flank and the projectile tail sided flank. The projectile head sided flank and/or the projectile tail sided flank can, for example, extend linear in the direction of the groove bottom and/or the groove bottom can be formed by a base surface oriented essentially parallel to the projectile central axis and/or a transition between projectile head sided flank and/or projectile tail sided flank and groove bottom can be formed by an edge, preferably at which the respective flank transitions into the groove bottom in a jump-like manner.

According to a further exemplary embodiment of the projectile according to the invention, an opening angle between the projectile head sided flank and the projectile tail sided flank starting from the groove bottom is in the range of 10°-90°, preferably in the range of 20°-80°, 30°-70° or 40°-60°. The opening angle can ensure that a sharp tear-off groove is provided, in particular to ensure the preferred deformation or partial fragmentation of the projectile and/or to ensure a controlled tear-off of the tail sided projectile section with respect to the tear-off groove from the front face projectile sections.

In a further exemplary embodiment of the projectile according to the invention, the tear-off groove is divided into groove segments arranged at a distance from one another at least in the circumferential direction and/or in the axial direction with respect to the central axis of the projectile. For example, two groove segments arranged at a distance from one another in the axial direction and in the circumferential direction with respect to the projectile central axis can overlap in the radial direction. According to an exemplary further development, at least three separate groove segments are evenly distributed in the circumferential direction with respect to the projectile central axis and/or each two tear-off groove segments are connected to one another by a wall protrusion. In this regard, the wall protrusion may be formed by the ogive-shaped wall.

According to a further aspect of the present invention, which may be combined with the preceding aspects and exemplary embodiments, a projectile, in particular a deformation and/or partial fragmentation bullet is provided. Bullets or projectiles are part of a cartridge or ammunition of a firearm, in particular a handgun. The projectile is the component of the cartridge which is fired by the firearm. A partial fragmentation bullet is generally designed to fragmentate in a controlled manner to a defined residual body upon impact of the bullet with a target. Deformation bullets generally have inherent mass-stable, controlled deformation. A partial fragmentation bullet may further be designed to fragmentate to a defined residual body in a controlled manner and/or to partially deform in a controlled manner upon impact of the bullet with a target. Controlled deformation of deformation bullets is generally designed to mushroom/fold upon impact with a target, with the deformation bullet generally remaining mass stable in the process. Such projectiles or bullets are used in particular as hunting bullets, since these lead more reliably to a quicker death of the game being shot at during hunting due to the effective energy release by partial fragmentation and/or defined deformation in the game body.

The projectile according to the invention comprises an essentially cylindrical projectile tail arranged rearwardly with respect to the projectile flight direction. The projectile may be formed substantially completely cylindrical and/or have a constant outer diameter with respect to a projectile central axis. In particular, the outer diameter of the projectile tail defines the caliber diameter. The projectile further comprises a bow sided substantially ogive-shaped projectile head adjacent to the projectile tail, the projectile head being forwardly disposed with respect to the projectile flight direction. The projectile head comprises a frontal, i.e., frontal with respect to the projectile flight direction and thus frontal on the projectile, substantially central opening oriented, for example, concentrically with respect to the projectile central axis. The opening may open into a cavity that extends axially from the projectile head in the direction of the projectile tail, preferably into the projectile tail, along the projectile central axis. The cavity has a cavity base pointing in the direction of the projectile tail and is bounded by a wall. For example, the wall completely surrounding the cavity in the circumferential direction. The wall of the projectile head may be substantially ogive-shaped in shape externally.

According to another aspect of the present invention, the projectile head wall comprises at least one flattened outer surface section deviating from an ogive-like shape. Here, flattened may be understood with respect to a curvature of the ogive-like shaped wall portion with respect to the projectile central axis. The outer surface section has a radial curvature with respect to the projectile central axis that is at least twice as great as a radial curvature with respect to the projectile central axis of an adjacent ogive-shaped section and/or the projectile tail. For example, the at least one surface section may be convexly curved and/or connected to an adjacent ogive-shaped section by means of a preferably substantially ogive-shaped transition edge oriented substantially in the longitudinal direction of the projectile.

According to an exemplary further development of the projectile according to the invention, the at least one outer surface section is produced by a cutting or forming fabrication process. For example, a pressing process may be used.

In another exemplary embodiment of a projectile according to the invention, the at least one outer surface section has an axial length in the longitudinal direction of the projectile of at least 30%, preferably at least 40%, at least 50% or at least 60%, of an axial length of the substantially ogive-shaped projectile head. For example, the at least one outer surface section may extend at least axially in a circumferential direction with respect to the projectile central axis by at least 45% and preferably at most 120%. The flattened outer surface sections may be formed such that a radial distance of the outer surface section from the projectile central axis is dimensioned smaller than a radial distance of an adjacent ogive-shaped section at the same axial height with respect to the projectile central axis.

According to an exemplary further development of the projectile according to the invention, at least two, preferably at least three or at least four, in particular identically shaped outer surface sections are formed on the projectile head sided wall. It may be provided that the at least two outer surface sections are separated at least in axial sections from an ogive-shaped section and/or merge into one another in axial sections in such a way that an ogive-shaped transition edge is formed. The transition edge may, for example, be oriented substantially in the longitudinal direction of the projectile, there being an angle with respect to the central axis of the projectile due to the substantially ogive-shaped shape of the projectile head.

According to an exemplary further development of the present invention, a tear-off groove is formed in the projectile head sided wall and at least partially, preferably completely, surrounding the cavity. In this regard, the tear-off groove may be formed, for example, in accordance with one of the exemplary embodiments described above with respect to the first aspect of the present invention.

According to a further exemplary further embodiment, the at least one outer surface section opens directly into the tear-off groove, in particular into a projectile head sided tear-off groove flank that extends from the wall in the direction of a tear-off groove bottom. In another exemplary embodiment of the projectile of the invention, the at least one outer surface section merges into a wall outer contour completely surrounding the opening such that a distance of the wall outer contour from the projectile central axis varies along the wall outer contour.

In another exemplary embodiment of the present invention, the at least one outer surface section is formed substantially flat. In the top view of the projectile, the projectile has a polygonal (triangular, quadrangular, etc.) structure on the projectile head side, wherein it may be provided, for example, that the respective corners at which adjacent portions, in particular outer surface section or ogive-shaped section, merge into one another may be rounded, while the corresponding wall outer contour portions at the outer surface sections are flat.

In another exemplary embodiment of the present invention, the projectile head wall is internally slotted, that means, it has at least one, preferably at least two, at least three or at least four, axial slots. For example, it is provided that the at least one axial slot extends from the central opening towards the projectile tail, preferably by at least 20%, preferably at least 30%, at least 40% or at least 50%, of an axial length of the cavity. According to the invention, it has been found that the internal slot in the cavity of the projectile has a beneficial effect on the desired deformation or partial fragmentation. In particular, the axial slots enhance the mushrooming deformation behavior in that adjacent projectile head wall sections separate from each other along an axial slot and thus can mushroom/unfold more easily and further the number of projectile fragments tearing off/partially fragmenting is increased.

In another exemplary embodiment of the present invention, a number of the axial slots is matched to a number of the outer surface sections, in particular, the number of axial slots corresponds to the number of outer surface sections. Alternatively or additionally, a circumferential position with respect to the projectile central axis of the at least one axial slot is matched to a circumferential position of the at least one outer surface section with respect to the projectile central axis such that the at least one axial slot is provided in the region of an ogive-shaped section, in particular in the region of the ogive-shaped transition edge of two adjacent outer surface sections.

Preferred embodiments are given in the subclaims.

Figure 1:
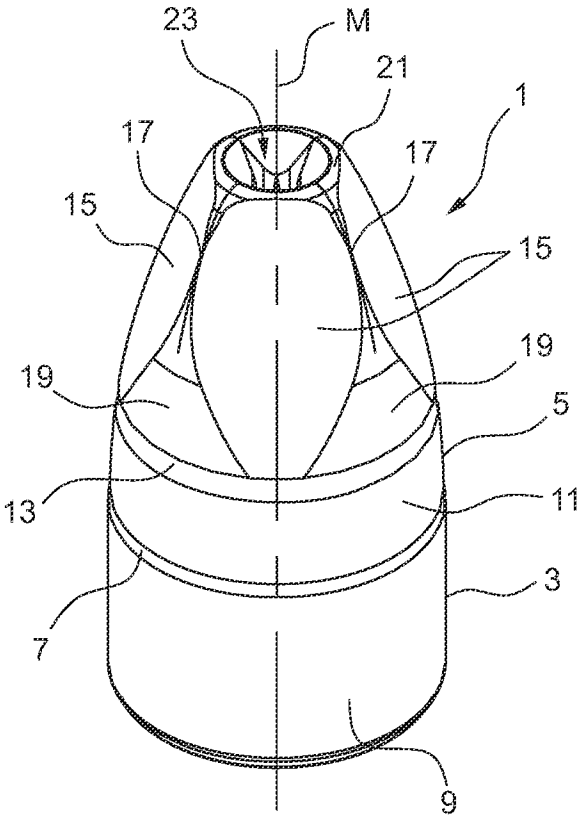
Figure 4:
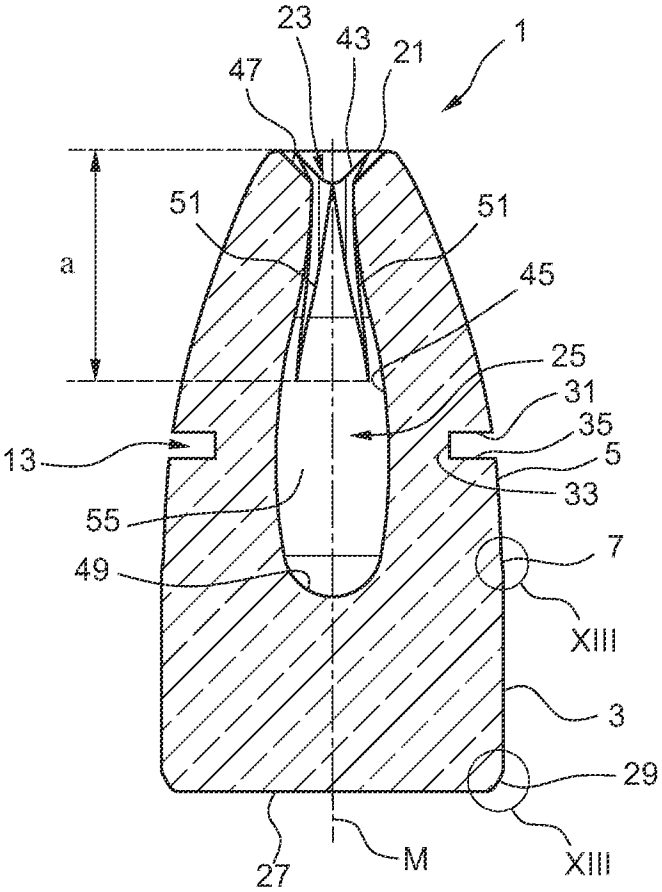
Figure 3:
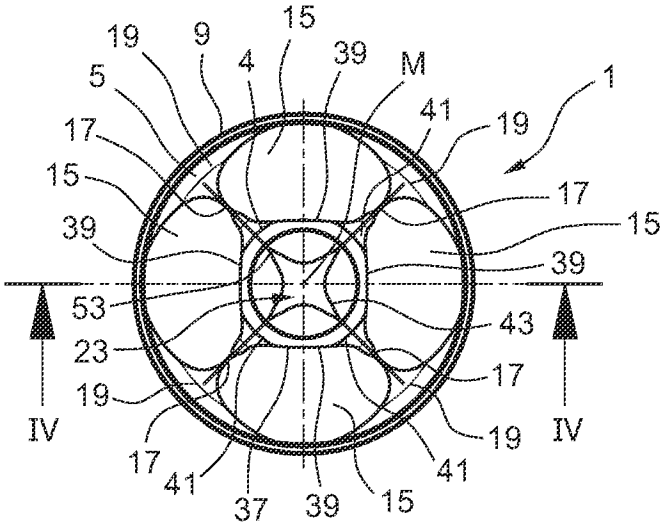
Figure 14:
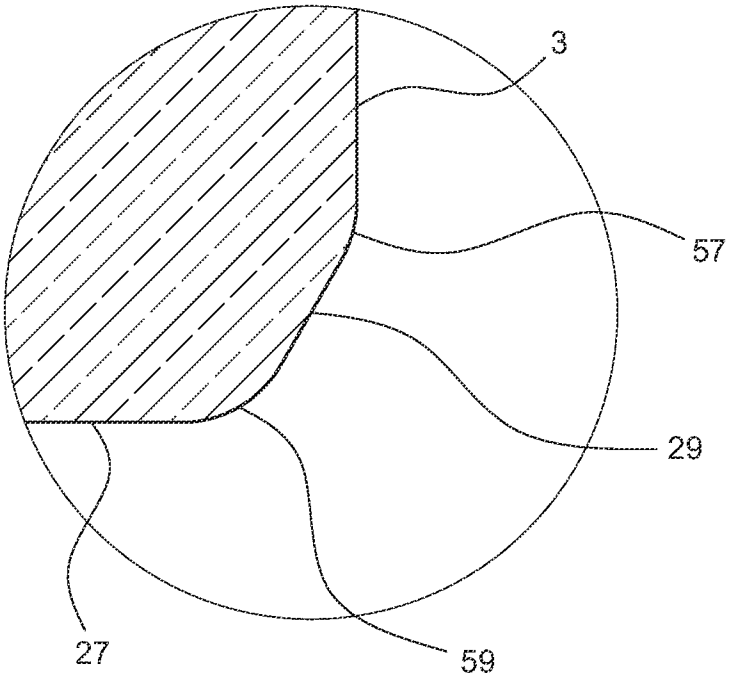
Figure 13:
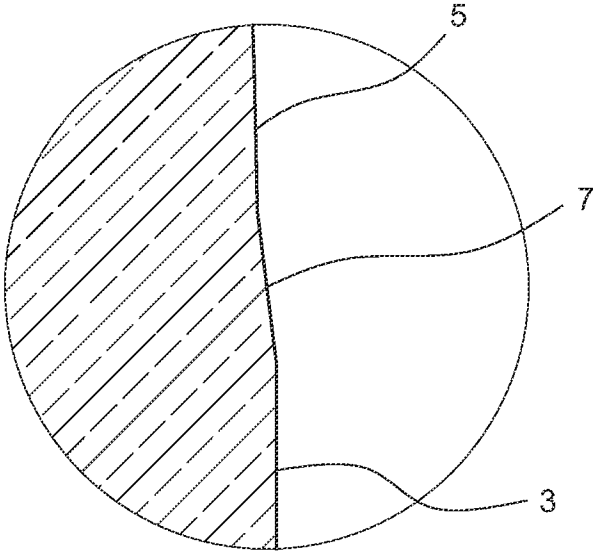
Figure 16:
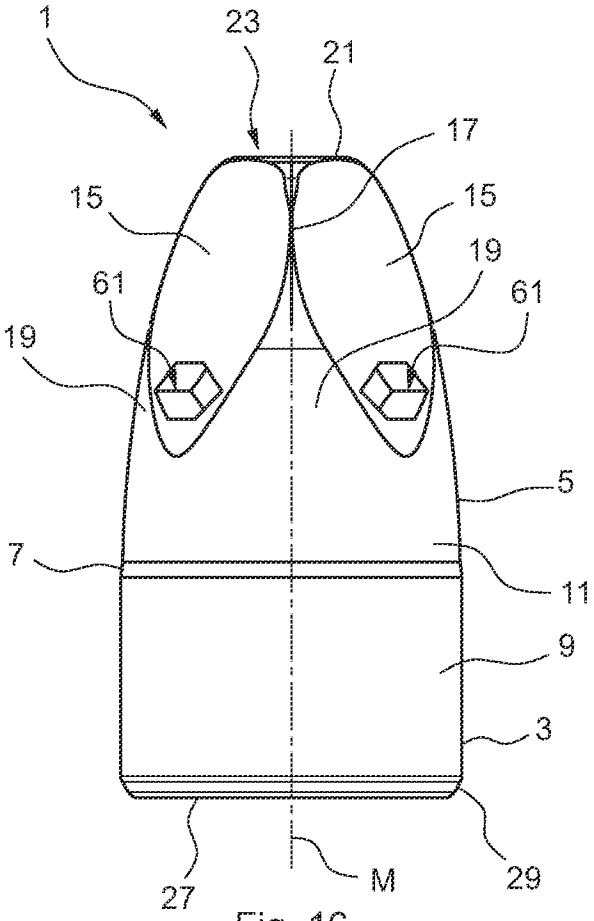
Figure 15:
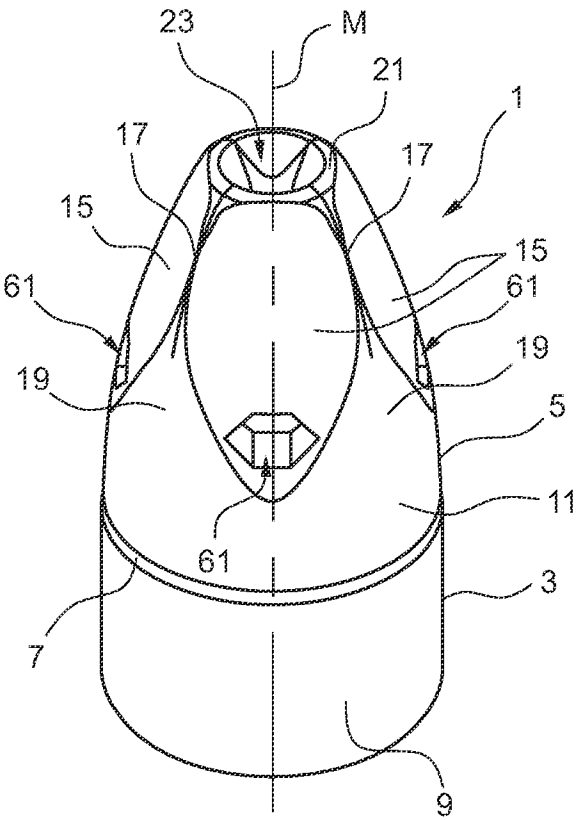
Figure 18:
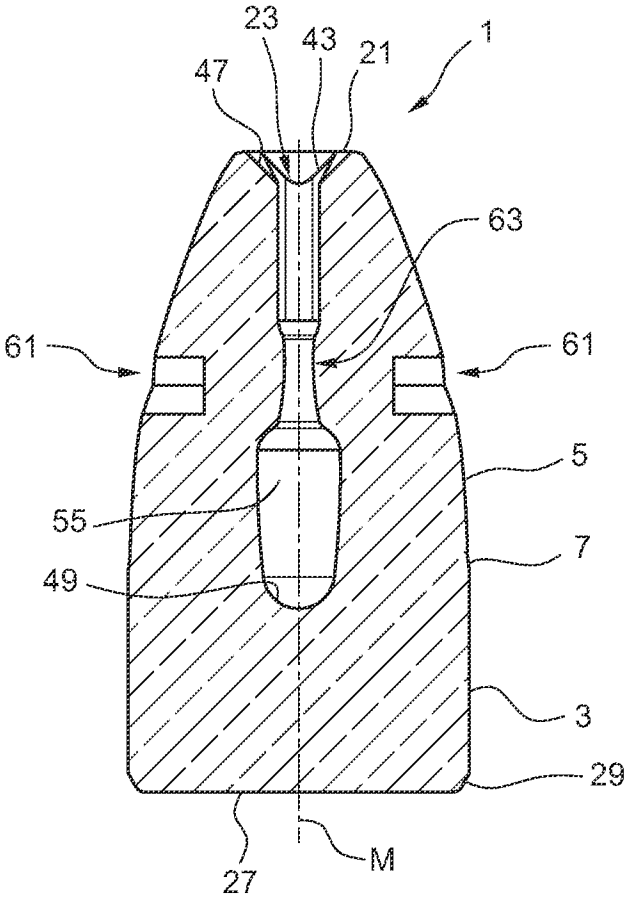
Figure 17:
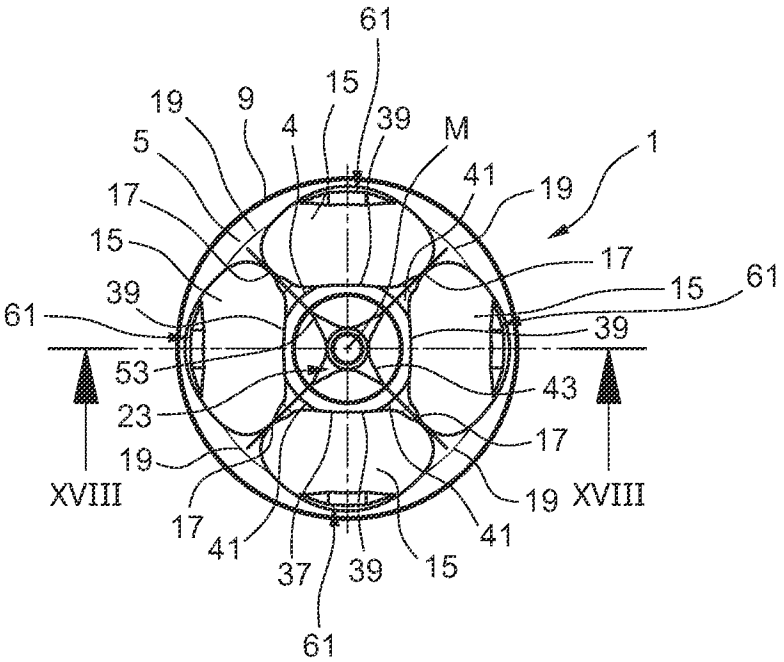
Figure 19:
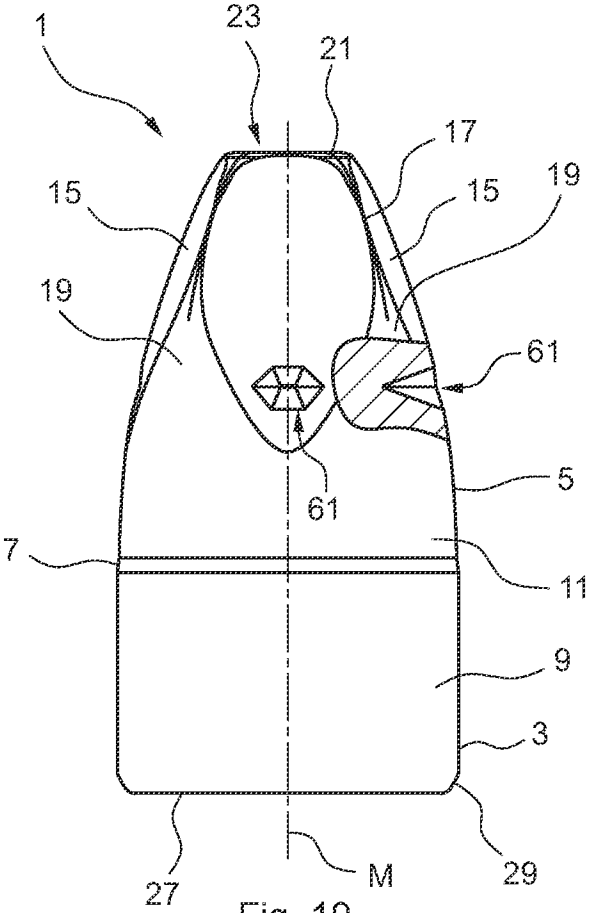
Figure 20H:
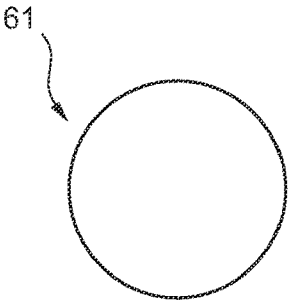
Figure 20G:
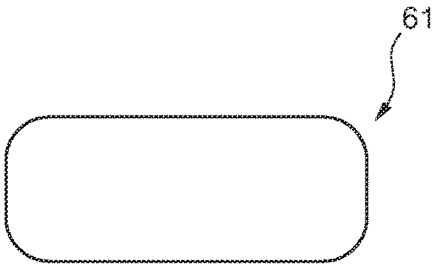
Figure 20F:
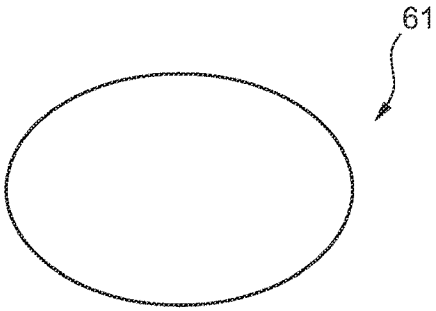
Figure 20E:
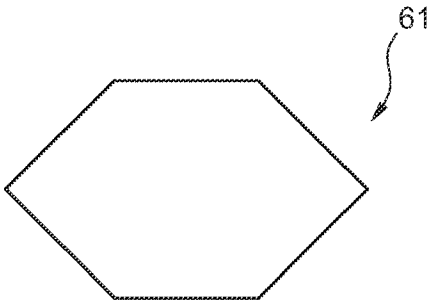
Figure 21D:
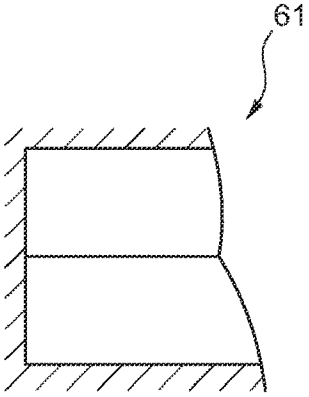
Figure 21C:
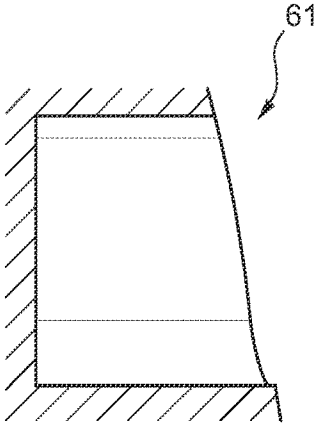
Figure 21B:
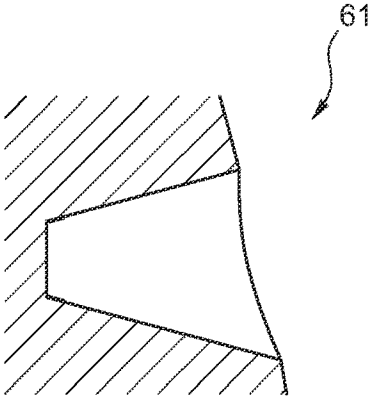
Figure 21A:
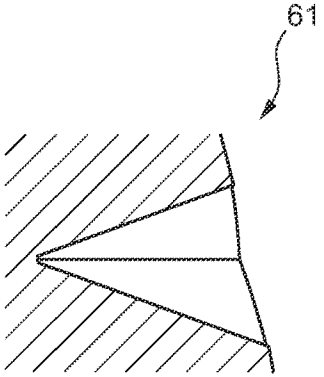
Figure 21H:
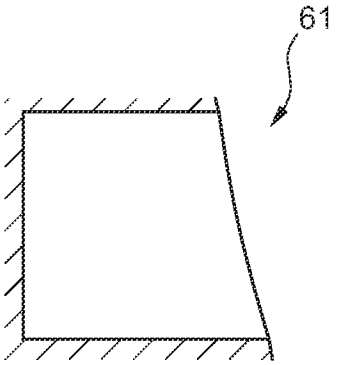
Figure 21G:
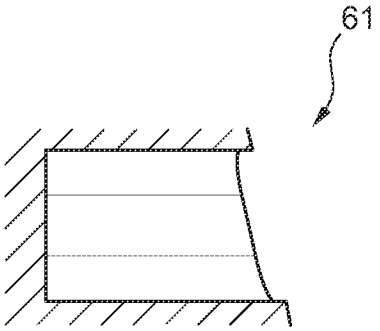
Figure 21F:
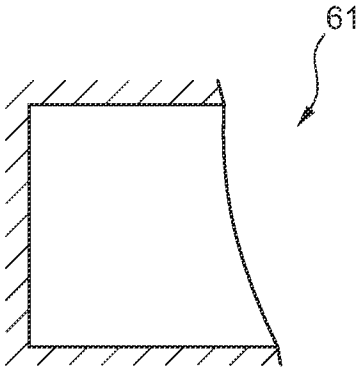
Figure 21E:
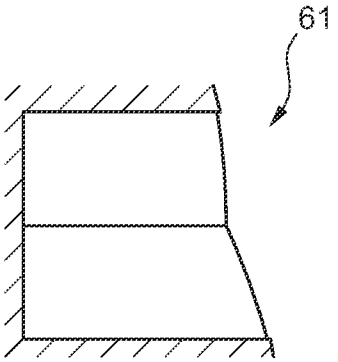

In the following, further properties, features and advantages of the invention will become clear by means of a description of preferred embodiments of the invention with reference to the accompanying exemplary drawings, in which show:

FIG. 1 a perspective view of an exemplary embodiment of a projectile according to the invention;

FIG. 2 a side view of the projectile according to FIG. 1,

FIG. 3 a top view of the projectile according to FIGS. 1, 2;

FIG. 4 a sectional view of the projectile according to FIGS. 1-3 according to line IV in FIG. 3;

FIG. 5 a schematic detailed view of an exemplary design of a tear-off groove of a projectile according to the invention;

FIG. 6 a schematic detailed view of an exemplary design of a tear-off groove of a projectile according to the invention;

FIG. 7 a schematic detailed view of an exemplary design of a tear-off groove of a projectile according to the invention;

FIG. 8 a schematic detailed view of an exemplary design of a tear-off groove of a projectile according to the invention;

FIG. 9 a schematic detailed view of an exemplary design of a tear-off groove of a projectile according to the invention;

FIG. 10 a schematic detailed view of an exemplary design of a tear-off groove of a projectile according to the invention;

FIG. 11 a schematic detailed view of an exemplary design of a tear-off groove of a projectile according to the invention;

FIG. 12 a schematic detail view of an exemplary design of a tear-off groove of a projectile according to the invention;

FIG. 13 a detailed view XIII according to FIG. 4;

FIG. 14 a detailed view XIV according to FIG. 4;

FIG. 15 a perspective view of a further exemplary embodiment of a projectile according to the invention;

FIG. 16 a side view of the projectile according to FIG. 15;

FIG. 17 a top view of the projectile according to FIGS. 15 and 16;

FIG. 18 a sectional view of the projectile of FIGS. 15 to 17;

FIG. 19 a further side view of the projectile according to FIGS. 15 to 18;

FIGS. 20*a* to 20*h* schematic detailed front views of exemplary embodiments of notches of projectiles according to the invention; and FIGS. 21*a* to 21*h* schematic detailed views of the notches according to FIGS. 20*a* to 20*h*.

In the following description of exemplary embodiments of projectiles according to the invention, a projectile according to the invention is generally designated by the reference number 1. In this context, identical or similar reference numbers are used for identical or similar components. For the following description of figures, reference is made exclusively to a projectile 1 for the sake of simplicity, it being clear that the explanations apply equally to deformation and/or partial fragmentation bullets 1 according to the invention. The projectiles illustrated in FIGS. 1-14 are manufactured from a single piece, for example by means of a forming process, it being clear that further production processes, such as machining manufacturing processes, may be applied to generate specific details of the projectiles 1 according to the invention. The projectiles 1 may be made of a homogeneous metal material, such as copper, copper alloy, brass, lead, etc. Preferably, the projectile 1 is made of a lead-free material. A projectile precursor (not shown) may be made from a cut precursor, which in particular may be formed from a cut ductile metal material. The projectile precursor is cold formed, for example, by means of pressing, in particular deep drawing, and in particular using a punch-matrix arrangement.

With reference to FIGS. 1-3, an exemplary embodiment of a projectile 1 according to the invention, in particular of a deformation and/or partial fragmentation bullet 1 according to the invention, is explained. With reference to FIGS. 5-14, specific components of the projectile 1 of FIGS. 1-4 are described in more detail.

The projectile 1 according to the invention shown in perspective view in FIG. 1 comprises an essentially cylindrical projectile tail 3 and an essentially ogive-shaped projectile head 5 adjoining it on the bow side. At the transition between projectile tail 3 and projectile head 5, a preferably completely circumferential chamfer 7 is formed, at which a diameter of the projectile 1 considered with respect to the projectile central axis, which is indicated schematically by means of the line with the reference sign M, is continuously reduced (see FIG. 13). It is the projectile tail whose outer diameter determines the caliber diameter of the projectile 1. In this respect, it is also the projectile tail 3, in particular its outer jacket 9, which is in contact with a barrel of a firearm and guides the projectile 1 in the firearm barrel when the projectile 1 is fired by means of the firearm.

In FIG. 1, it is already indicated that on an outer side of a wall 11 forming the projectile head 5, an tear-off groove 13 is formed which, according to the exemplary embodiment, completely surrounding the projectile central axis M. The tear-off groove 13 will be referred to in more detail in the description of FIGS. 2, 4-12.

Furthermore, it can be seen in FIG. 1 that the projectile head wall 11 has at least one (in FIG. 1 four, only three being apparent) flattened outer surface section 15 deviating from an ogive-shaped shape. Two adjacent outer surface sections 15, which are produced, for example, by a cutting and/or forming production process, preferably by means of a pressing process, are separated from one another axially in sections by an ogive-shaped transition edge 17. Furthermore, two adjacent outer surface sections 15 are each separated from one another axially in sections by an ogive-shaped section 19. Both the ogive-shaped sections 19 and the outer surface sections 15 each open directly into the tear-off groove 13.

At a end face 21 of the projectile 1 facing in the direction of projectile flight, an essentially central opening 23 is made in the projectile 1, which opens into a cavity 25 (FIG. 4).

Referring to FIG. 2, it can be seen that the projectile 1 has an essentially flat projectile ground 27 which merges into the substantially cylindrical projectile tail wall 9 through a chamfer section 29 formed circumferentially on the projectile tail 3. It can further be seen in FIG. 2 that the tear-off groove 13 is substantially realized as a material recess, such as a groove, which completely surrounding the projectile central axis M. It can further be seen that the tear-off groove 13 is substantially U-shaped, with a projectile head sided flank 31 that extends from an ogive-shaped projectile head wall 11 to a groove bottom 33 oriented substantially in the longitudinal direction of the projectile and/or formed substantially flat. The groove bottom 33 in turn opens into a projectile tail sided flank 35, which extends radially outwardly from the groove bottom 33 to an ogive-shaped projectile front wall 11 and merges therewith.

FIG. 2 also shows the shape of flattened outer surface sections 15 that extends in the longitudinal direction of the projectile by at least 30%, preferably at least 40%, at least 50% or at least 60%, of an axial length of the substantially ogive-shaped projectile head 5. Furthermore, the outer surface sections 15 form at least axially in circumferential direction with respect to the projectile central axis M by at least 45°, in FIG. 2 90°, at which axial position two adjacent outer surface sections 15 are separated from each other by an ogive-shaped transition edge 17. The ogive-shaped transition edges 17 merge in the axial direction at the tail and possibly at the front into an ogive-shaped section 19 each, which separates two adjacent outer surface sections 15 from each other in axial sections and also opens directly into the tear-off groove 13, in particular into the projectile head sided flank 31. In the side view (FIG. 2), the ogive-shaped sections 19 have an essentially triangular structure, with one short side opening at the tail into the projectile head sided flank 31 and the two opposite long sides lying at the transition to one outer surface section 15 each. The outer surface sections 15 are thereby formed substantially flat, thus not ogive-shaped shaped, as for example the adjacent ogive-shaped sections 19. Each two adjacent outer surface sections 15 are inclined to each other, wherein the angle of inclination between two adjacent outer surface sections 15 according to FIGS. 1-4 is exemplarily in the range of 80° to 110°, preferably about 90°.

In the top view according to FIG. 3, in particular a wall outer contour 37 completely surrounding the central opening 23 can be seen. The wall outer contour 37 is formed on the end face 21 of the projectile 1 and forms an axial end of a corresponding outer surface section 15. In FIG. 3, it can be seen that a distance of the wall outer contour 37 from the projectile central axis M varies in the course of the wall outer contour 37. In the top view as shown in FIG. 3, the wall outer contour 37 forms polygon like structure of two pairs of opposing contour portions 39 that extends substantially in a linear present in the region of outer surface sections 15 and two pairs of opposing curvature portions 41 arranged in the region of ogive-shaped section 19 of the projectile head 3. Further indicated in FIG. 3 is a slot 43 formed in the cavity 25, that extends substantially from the central opening 23 toward the projectile tail 3 and formed in a cavity inner area 45 of the cavity 25.

In FIG. 4, a sectional view of the projectile 1 according to FIGS. 1-3 is shown by means of the line IV-IV in FIG. 3. With reference to FIG. 4, the cavity 25 is described in particular. The cavity 25 extends from the central opening 23 in the direction of the projectile tail 3 and, as shown by way of example in FIG. 4, axially in sections into the projectile tail 3. An axial length of the cavity 25 is at least 30%, preferably at least 40%, at least 50% or at least 60%, of a longitudinal extension of the projectile 1. Immediately adjacent to the central opening 23, the cavity 25 has a funnel section 47 at which an inner diameter of the cavity 25 decreases continuously. Subsequently, the cavity 25 widens substantially continuously, namely up to an axial position of the tear-off groove 13. From the axial position of the tear-off groove 13, the cavity 25 tapers until this ends in a cavity bottom 49. In this case, the cavity 25 can have essentially a drop-shape. In order to achieve the controlled and defined deformation and/or partial fragmentation according to the invention, it is provided that the tear-off groove 13 is arranged at an axial distance of at least 10% of the longitudinal extension of the cavity 25 from the cavity bottom 49. Furthermore, a radial depth of the tear-off groove 13 may be at least 10% of a caliber diameter, in particular an outer diameter of the projectile tail wall 9, and/or of at least 30% of a radial wall thickness of the wall 11 surrounding the cavity 25.

Looking at FIGS. 3 and 4 together, the slot 43 is formed by four axial slots 51, preferably distributed uniformly in the circumferential direction with respect to the projectile central axis M, which extend from the central opening 23 in the direction of the projectile tail 3. An exemplary axial length a of the axial slots 51 is at least 20%, preferably at least 30%, at least 40% or at least 50% of an axial length of the cavity 25. Furthermore, it can be seen that a number of the axial slots 51 is adapted to a number of the outer surface sections 15, in particular is identical thereto. Further, a circumferential position of the axial slot 51 is matched to a circumferential position of the outer surface sections 15 such that the axial slots 51 are positioned in the region of the ogive portions 19. For example, a slot base 53 of an axial slot 51 points in the direction of the transition edge 17 or ogive section 19. In top view (FIG. 3), the slot 43 may be shaped as an intersection. In FIG. 4, it can be seen that the cavity 25 has an axial slot-free region 55 in which no axial slot 51 is provided.

With reference to FIGS. 5-12, structures of tear-off grooves 13 are explained, as examples. In FIGS. 5-12, a radial depth r of the tear-off groove is indicated by the reference sign r, a radial depth r being dimensioned from the outer wall side 11 to the groove bottom 33. The groove bottom 33 is realized as a radius R according to the embodiments of FIGS. 5-8, while the groove bottom 33 according to FIGS. 9-12 is formed as an essentially flat base surface that extends parallel to the projectile central axis. The designs of FIGS. 5-8 differ from one another essentially in the radial depth r of the tear-off groove 13 and in the opening angle that is set between the two opposite flanks 31, 35 forming the tear-off groove 13. Furthermore, an axial height b of the tear-off groove 13 can also vary, as can be seen by looking at FIGS. 5-8 together.

FIGS. 9-12 again show differences of the tear-off groove 13 in terms of opening angle as well as axial height b and/or radial depth r. Thereby, an axial dimensioning of the recess base 33 can also vary. In the exemplary embodiments of FIGS. 5-12, the flank 35 on the projectile tail side and the flank 31 on the projectile head sided are each formed by essentially flat surfaces, although it is also conceivable that the flanks 31, 35 are curved, in particular have a radius and/or merge into the recess base 33 through a radius.

FIG. 13 shows the detailed view XIII according to FIG. 4 in the area of the circumferential chamfer 7. The chamfer 7 can, for example, be oriented by less than 10° with respect to the adjoining projectile head wall 11 and have an axial length of less than 1 mm.

FIG. 14 shows a detailed view XIV according to FIG. 4. Here it can be seen that a radius 57, 59 is provided at the respective transition of the chamfer section 29 into the projectile tail wall 9 or the projectile ground 27.

FIGS. 15 to **21*h* show a further exemplary embodiment of a projectile 1** according to the invention. In the following description, identical or similar components are provided with identical or similar reference numbers. To avoid repetition, essentially only the differences arising with respect to the preceding embodiments will be discussed.

In general, the tear-off groove 13 according to the alternative exemplary embodiment only partially surrounding the cavity 25. For example, the tear-off groove 13 is segmented in the circumferential direction. In other words, the tear-off groove 13 has at least two tear-off groove sections, such as notching or recesses or notches 61, distributed in the circumferential direction and spaced apart from each other as viewed in the circumferential direction. The tear-off groove 13 may have a plurality of tear-off groove sections, in particular notches or recesses or notches 61, distributed in particular uniformly in the circumferential direction, which may be located at the same axial height with respect to a projectile longitudinal axis.

The notches 61 may be introduced into the projectile wall from the outside by means of a cold forming process, such as pressing, and may support radial bending up or folding up of the ogive section 19.

As can be seen in particular from a combination of the perspective view according to FIG. 15 and the top view according to FIG. 17 of the projectile 1 according to the invention, the tear-off groove 13 has a total of four notches 61 distributed uniformly in the circumferential direction. From the side view according to FIG. 16 and the sectional view according to FIG. 18, it is further apparent that the notches 61 are arranged at substantially the same axial height with respect to the longitudinal axis of the projectile.

With reference to the sectional view according to FIG. 18, a manufacturing-specific feature is also apparent. When producing the notches 61 of the tear-off groove 13 by means of cold forming, in particular pressing, a constriction 63 of the cavity 25 located at the same axial height as the notches 61 can result. As a result of the pressing process from the outside, projectile material is pressed radially inwards with respect to the notches 61, as a result of which the in particular drop-like shaped cavity according to the embodiment of FIGS. 1 to 4 is altered such that the cavity 25 narrows at the axial height of the notches 61.

Figure 20B:
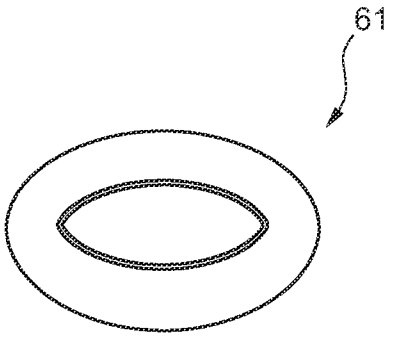
Figure 20D:
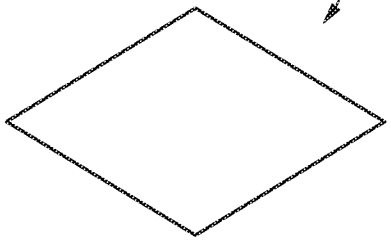
Figure 20A:
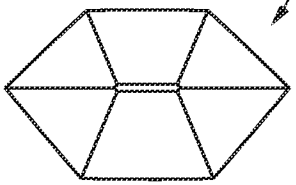
Figure 20C:
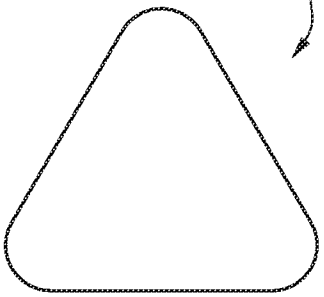

FIGS. 20*a* to 21*h* show exemplary embodiments of notches 61 in detailed view. Here, FIGS. 20*a* to 20*h* show the notches 61 from the front and FIGS. 21*a* to 21*h* show them in side or sectional view. Furthermore, the numbering is to be understood in such a way that the lower case letter after the figure numbering a, b stands for an embodiment variant, so that, for example, FIGS. 20*a* and 21*a* show the same notch shape 61, once from the side and once from the front. The same applies to FIGS. 20*b* and 21*b* to 20*h* and 21*h*, respectively. Embodiment variant a is hexagonal in top view and substantially triangular in side sectional view. The embodiment variant b is oval in top view and trapezoidal in side sectional view. Embodiment c is triangular in top view with rounded corners and substantially angular in side sectional view. Embodiment d shows a diamond-shaped notch 61 in top view, which is formed in a substantially constant manner in the radial direction, i.e. has a constant cross-section. Embodiment form e is substantially the same as embodiment form a, although viewed in the radial direction the notch 61 of embodiment form e has a constant cross-section, whereas the notch 61 of embodiment form e tapers in cross-section, as can be seen in FIG. 20*a* and in particular 21*a*. The same applies to embodiment f. This is essentially analogous to embodiment b, but has a constant cross-section in the radial direction. The embodiment form g is elongated rectangular with rounded corners and constant in cross-section. The embodiment form h shows a notch 61 which is round in top view and has a constant cross-section, resulting in a cylinder-like notch 61.

The features disclosed in the foregoing description, the figures and the claims may be of importance both individually and in any combination for the realization of the invention in the various embodiments.

LIST OF REFERENCE SIGNS

1 projectile
3 Projectile tail
5 Projectile head
7 chamfer
9 projectile tail wall
11 projectile head wall
13 tear-off groove
15 outer surface section
17 transition edge
19 ogive-shaped section
21 end face
23 central opening
25 cavity
27 projectile ground
29 chamfer section
31 projectile head sided flank
33 groove bottom
35 projectile tail sided flank
37 wall outer contour
39 straight wall outer contour section
41 curved wall outer contour section
43 slot
45 cavity inner area
47 funnel section
49 cavity bottom
51 axial slot
53 Slot bottom
55 Axial slot free area
57, 59 radius
61 notch
63 Constriction
M projectile central axis
R radius
a axial length of an axial slot
r radial depth
b axial height

The invention claimed is:

1. A projectile, comprising a substantially cylindrical projectile tail, a forwardly disposed projectile head with a substantially central opening which opens into a cavity that extends axially from the projectile head in the direction of the projectile tail, which has a cavity bottom and is bounded by a wall, and an tear-off groove introduced into the wall and at least partially surrounding the cavity, which is arranged at a distance of at least 10% of a longitudinal extension of the cavity from the cavity bottom and has a radial depth of at least 10% of a caliber diameter of the projectile and/or of at least 30% of a radial wall thickness of the wall surrounding the cavity.

2. The projectile according to claim 1, wherein at the transition between projectile tail and projectile head, a circumferential chamfer is formed, at which a diameter with respect to the projectile center axis of the projectile continuously decreases.

3. The projectile according to claim 1, wherein the cavity extends by at least 30% of a longitudinal length of the projectile.

4. The projectile according to claim 1, wherein the cavity widens substantially continuously starting from the opening up to an axial position of the tear-off groove, at which the cavity tapers continuously and/or wherein the cavity has a substantially drop shape.

5. The projectile according to claim 1, wherein the tear-off groove is substantially formed U-shaped or V-shaped.

6. The projectile according to claim 5, wherein the tear-off groove comprises a projectile head sided flank, a projectile tail sided flank, and a groove bottom connecting the projectile head sided flank and the projectile tail sided flank, wherein the projectile head sided flank and/or the projectile tail sided flank is curved and/or wherein the groove bottom is formed by a radius and/or wherein a transition between projectile head sided flank and/or projectile tail sided flank and groove bottom is formed by a radius.

7. The projectile according to claim 6, wherein an opening angle between projectile head sided flank and projectile tail sided flank starting from the groove bottom is in the range from 10° to 90°.

8. The projectile according to claim 5, wherein the tear-off groove comprises a projectile head sided flank, a projectile tail sided flank, and a groove bottom connecting the projectile head sided flank and the projectile tail sided flank, wherein the projectile head sided flank and/or the projectile tail sided flank extends rectilinearly in the direction of the groove bottom and/or wherein the groove bottom is formed by a base surface oriented substantially parallel to the projectile center axis and/or wherein a transition between projectile head sided flank and/or projectile tail sided flank and groove bottom is formed by an edge.

9. The projectile according to claim 1, wherein the tear-off groove is divided into at least two groove segments arranged at a distance from one another in the circumferential direction and/or in the axial direction with respect to the projectile central axis, wherein in particular at least three separate groove segments are distributed uniformly in the circumferential direction with respect to the projectile central axis and/or wherein two adjacent groove segments are each connected to one another by a wall web.

10. The projectile according to claim 1, wherein the cavity that extends axially from the projectile head into the projectile tail.

* * * * *